US009031466B2

(12) United States Patent
Fujimoto et al.

(10) Patent No.: US 9,031,466 B2
(45) Date of Patent: May 12, 2015

(54) IMAGE FORMING APPARATUS HAVING POSITION ADJUSTABLE DRIVE UNIT

(71) Applicants: Takashi Fujimoto, Hyogo (JP); Kimihiro Tanaka, Osaka (JP); Kunihiko Nishioka, Osaka (JP)

(72) Inventors: Takashi Fujimoto, Hyogo (JP); Kimihiro Tanaka, Osaka (JP); Kunihiko Nishioka, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/051,652

(22) Filed: Oct. 11, 2013

(65) Prior Publication Data

US 2014/0119777 A1 May 1, 2014

(30) Foreign Application Priority Data

Oct. 31, 2012 (JP) ..... 2012-239898

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 15/757* (2013.01); *G03G 21/1647* (2013.01); *G03G 21/1857* (2013.01)

(58) Field of Classification Search

CPC ..... G03G 15/757; G03G 21/1857; G03G 21/1647

USPC ..... 399/167

See application file for complete search history.

(56) References Cited

U.S. PATENT DOCUMENTS

| | | | | |
|---|---|---|---|---|
| 5,631,726 | A * | 5/1997 | Sawada | 399/167 X |
| 7,526,232 | B2 * | 4/2009 | Kamimura et al. | 399/167 |
| 7,929,883 | B2 * | 4/2011 | Lee | 399/167 |
| 2010/0239318 | A1 * | 9/2010 | Maehata et al. | 399/167 |

FOREIGN PATENT DOCUMENTS

| | | |
|---|---|---|
| JP | 1-222269 | 9/1989 |
| JP | 2004-109766 | 4/2004 |
| JP | 2006-133497 | 5/2006 |
| JP | 2008-083342 | 4/2008 |
| JP | 2010-097233 | 4/2010 |

* cited by examiner

*Primary Examiner* — Sandra Brase

(74) *Attorney, Agent, or Firm* — Harness, Dickey & Pierce, P.L.C.

(57) ABSTRACT

An image forming apparatus includes a body, an image carrier provided in the body and configured to form an image thereon, a first gear to transmit a rotation driving force to the image carrier, a first rotary shaft to which the image carrier and the first gear are attached, a second gear to mesh with the first gear and transmit the rotation driving force to the first gear, a second rotary shaft to which the second gear is attached, a drive source configured to drive to rotate the image carrier via the first gear and the second gear, a first holder to hold the first rotary shaft of the first gear, and a second holder to hold the second rotary shaft of the second gear, and a relative position between the first holder and the second holder therein is adjustable.

11 Claims, 11 Drawing Sheets

IMAGE FORMING APPARATUS HAVING POSITION ADJUSTABLE DRIVE UNIT

CROSS-REFERENCE TO RELATED APPLICATIONS

This patent application is based on and claims priority pursuant to 35 U.S.C. §119 to Japanese Patent Application No. 2012-239898, filed on Oct. 31, 2012 in the Japan Patent Office, the entire disclosure of which is hereby incorporated by reference herein.

BACKGROUND

1. Technical Field

Embodiments of the present invention relate to an image forming apparatus that functions as a printer, a facsimile machine, a copier, and so forth and prevents image formation failure.

2. Related Art

Known image forming apparatuses generally include a photoconductor and a drive unit. The photoconductor functions as an image carrier to form a toner image on a surface thereof to transfer the toner image onto a recording medium or onto an image transfer body. The drive unit drives the photoconductor functioning as a driven member.

Japanese Patent No. JP-4820908-B (JP-2010-097233-A) discloses an image forming apparatus having a configuration in which a drive unit transmits a driving force from a motor to a photoconductor via a photoconductor gear and a drive gear by meshing a photoconductor gear provided to a rotary shaft of a photoconductor with a drive gear having a rotary shaft is held by a holding member of a body of a drive unit.

However, due to processing accuracy and/or assembly error of parts included in the drive unit, a distance between the rotary shaft of the photoconductor gear and the rotary shaft of the photoconductor drive gear can be shifted from a target distance. In such a case, the photoconductor gear and the photoconductor drive gear do not mesh with each other properly, and therefore vibrate when the drive unit drives the photoconductor gear and the photoconductor drive gear. Consequently, an image transferred from the photoconductor onto the recording medium or the intermediate transfer body has an image failure caused by the vibration such as banding.

SUMMARY

The present invention provides an image forming apparatus including a body, an image carrier provided in the body and configured to form an image thereon, a first gear configured to transmit a rotation driving force to the image carrier, a first rotary shaft to which the image carrier and the first gear are attached, a second gear configured to mesh with the first gear and transmit the rotation driving force to the first gear, a second rotary shaft to which the second gear is attached, a drive source configured to drive to rotate the image carrier via the first gear and the second gear, a first holder to hold the first rotary shaft of the first gear, and a second holder to hold the second rotary shaft of the second gear. A relative position between the first holder and the second holder is adjustable.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
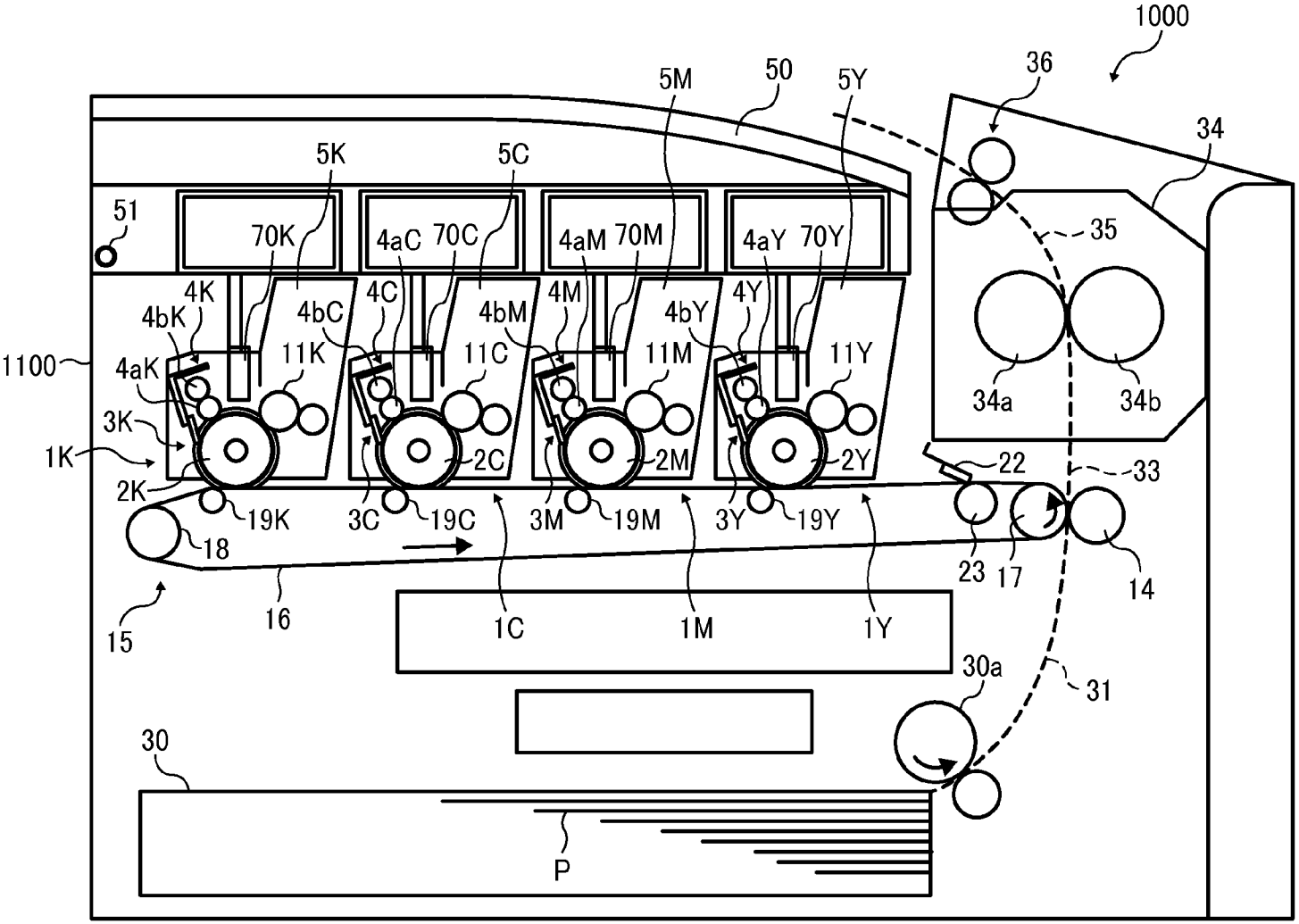
FIG. 1 is a vertical cross sectional view illustrating a schematic configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath". "below". "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of a schematic basic configuration of an image forming apparatus 1000 according to an embodiment of the present invention, with reference to FIG. 1.

FIG. 1 is a vertical cross sectional view illustrating a schematic configuration of an image forming apparatus 1000 according to an embodiment of the present invention. The image forming apparatus 1000 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1000 is an electrophotographic color printer that forms color and monochrome toner images on recording media by electrophotography.

As described in FIG. 1, the image forming apparatus 1000 includes units and components for image forming in a body 1100 thereof such as four image forming units 1Y, 1M, 1C, and 1K to form yellow (Y), magenta (M), cyan (C), and black (K) toner images, respectively. The image forming units 1Y, 1M, 1C, and 1K employ different single color toners, which are yellow (Y), magenta (M), cyan (C), and black (K) toners. Except for the colors of toners, the image forming units 1Y, 1M, 1C, and 1K have configurations identical to each other. Each of the image forming units 1Y, 1M, 1C, and 1K can be replaced when the service life thereof expires.

Hereinafter, the units and components included in the body 1100 of the image forming apparatus 1000 are often referred to in a singular unit without suffix indicating toner colors. For example, the image forming units 1Y, 1M, 1C, and 1K may be referred to as "the image forming unit 1".

As illustrated in FIG. 1, the image forming unit 1 includes a photoconductor 2 (i.e., photoconductors 2K, 2C, 2M, and 2Y), a drum cleaning unit 3 (i.e., drum cleaning units 3K, 3C, 3M, and 3Y), a charge removing unit, a charging unit 4 (i.e., charging units 4K, 4C, 4M, and 4Y), a development unit 5 (i.e., development units 5K, 5C, 5M, and 5Y), and a writing head 70 (i.e., writing heads 70K, 70C, 70M, and 70Y) functioning as an electrostatic latent image forming member. The image forming unit 1 is a process cartridge that is detachably attachable to the body 1100 of the image forming apparatus 1000. Accordingly, parts and units in the image forming unit 1 reaching each service life can be replaced at a time.

The charging unit 4 includes a charging roller 4*a* (i.e., charging rollers 4*a*K, 4*a*C, 4*a*M, and 4*a*Y) and a collection roller 4*b* (i.e., collection rollers 4*b*K, 4*b*C, 4*b*M, and 4*b*Y). The charging roller 4*a* contacts the photoconductor 2, which is driven to rotate by a drive unit counterclockwise in FIG. 1. The collection roller 4*b* collects toner adhered to the charging roller 4*a*. An electric discharge generated between the charging roller 4*a* and the photoconductor 2 can uniformly charge a surface of the photoconductor 2.

The writing head 70 exposes the charged surface of the photoconductor 2 to form an electrostatic latent image for a given single color toner image. The development unit 5 develops the electrostatic latent image to the single color toner image with a corresponding color toner. The single color toner image is later transferred onto a surface of an intermediate transfer belt 16.

The drum cleaning unit 3 removes residual toner remaining on the surface of the photoconductor 2 after the single color toner image has been transferred onto the surface of the intermediate transfer belt 16, so that the surface of the photoconductor 2 is cleaned.

The charge removing unit electrically removes residual charge remaining on the surface of the photoconductor 2 after the drum cleaning unit 3 cleaned the surface of the photoconductor 2. This removal of charge ionizes and initializes the surface of the photoconductor 2. Accordingly, the photoconductor 2 becomes ready for a subsequent image forming operation.

The development unit 5 includes a development roller 11 (i.e., development rollers 11Y, 11M, 11C and 11K). The development roller 11 rotates while contacting the photoconductor 2. Toner electrically held on a surface of the development roller 11 is attracted and transferred onto the electrostatic latent image formed on the surface of the photoconductor 2 in a development region in which the development roller 11 and the photoconductor 2 contact each other. This attraction of toner causes the electrostatic latent image formed on the surface of the photoconductor 2 to be developed to the single color toner image having a corresponding color.

The writing head 70 includes multiple light emitters such as light emitting diodes (LEDs) and organic electroluminescence (OEL) elements aligned in an axial direction of the photoconductor 2. The writing head 70 emits light based on image data of an image to be printed out and irradiates a given position on the surface of the photoconductor 2. With this action, the surface of the photoconductor 2 is exposed to form the electrostatic latent image on the surface of the photoconductor 2. As a result, the electrostatic latent image on the surface of the photoconductor 2 is developed to the single color toner image having a corresponding color.

The image forming apparatus 1000 further includes a transfer unit 15 disposed below the image forming units 1Y, 1M, 1C, and 1K. The transfer unit 15 includes an intermediate transfer belt 16, a drive roller 17, a driven roller 18, four primary transfer rollers 19Y, 19M, 19C, and 19K (hereinafter, often referred to as a primary transfer roller 19), a secondary transfer roller 14, a belt cleaning unit 22, and a cleaning backup roller 23.

The intermediate transfer belt 16 is an endless belt functioning as a transfer member.

The intermediate transfer belt 16 is stretched with a tension around the drive roller 17, the driven roller 18, the primary transfer rollers 19Y, 19M, 19C, and 19K, and the cleaning backup roller 23 to rotate counterclockwise in FIG. 1. The drive roller 17, the driven roller 18, the primary transfer rollers 19Y, 19M, 19C, and 19K, and the cleaning backup roller 23 are disposed inside the loop of the endless intermediate transfer belt 16. A drive unit rotates the drive roller 17 counterclockwise in FIG. 1. With a rotational force or torque of the drive roller 17 in a counterclockwise direction, the intermediate transfer belt 16 is rotated in the same direction of the drive roller 17.

The four primary transfer rollers 19Y, 19M, 19C, and 19K are disposed facing the photoconductors 2Y, 2M, 2C, and 2K, respectively, with the endlessly rotating intermediate transfer belt 16 interposed therebetween. With this configuration, the photoconductors 2Y, 2M, 2C, and 2K contacts an outer surface of the intermediate transfer belt 16 to form respective primary transfer nip areas therebetween.

A primary transfer bias is applied by a transfer bias power supply to each of the primary transfer rollers 19Y, 19M, 19C, and 19K. The application of the primary transfer bias generates a primary electric field in the primary transfer nip area for primarily transferring an image between the electrostatic latent image formed on the photoconductor 2 and the primary transfer roller 19. It is to be noted that the transfer unit 15 can employ a transfer charger or a transfer brush instead of the primary transfer roller 19.

As the photoconductor 2Y of the image forming unit 1Y for forming yellow toner images rotates, a yellow toner image formed on the surface of the photoconductor 2Y reaches the primary transfer nip area. By entering and passing through the primary transfer nip area, the yellow toner image is transferred from the photoconductor 2Y onto the intermediate transfer belt 16 due to action of the primary electric field and a nip pressure in the primary transfer nip area. Similarly, as the magenta toner image formed on the photoconductor 2M, the cyan toner image formed on the photoconductor 2C, and the black toner image formed on the photoconductor 2K enter and pass through the respective primary transfer nip areas, these toner images are sequentially transferred onto the intermediate transfer belt 16 in a manner of overlaying the previously transferred toner image on the surface of the intermediate transfer belt 16. According to the action that the primary transfer in which the yellow, magenta, cyan, and black toner images are overlaid sequentially, a four-color toner image is formed on the surface of the intermediate transfer belt 16.

The secondary transfer roller 14 of the transfer unit 15 is disposed outside the loop of the intermediate transfer belt 16 and sandwich the intermediate transfer belt 16 together with the drive roller 17 that is disposed inside the loop. With this interposal of the intermediate transfer belt 16, a secondary transfer nip area is formed between the outer surface of the intermediate transfer belt 16 and the secondary transfer roller 14. A secondary transfer bias is applied to the secondary transfer roller 14 by a transfer bias power source. The application of the secondary transfer bias generates a secondary electric field in the secondary transfer nip area for secondarily transferring an image between the secondary transfer roller 14 and the drive roller 17 that is grounded.

A sheet tray 30 is disposed below the transfer unit 15 to be detachably attachable to the body 1100 of the image forming apparatus 1000. The sheet tray 30 includes a sheet feed roller 30*a* and accommodates a stack of recording media including a recording medium P. An uppermost recording medium P placed on top of the stack of recording media contacts the sheet feed roller 30*a*. As the sheet feed roller 30*a* rotates at a given timing in a counterclockwise direction in FIG. 1, the uppermost recording medium P is fed toward a sheet feeding path 31.

The sheet feeding path 31 extends from the sheet feed roller 30*a* toward a registration roller pair. The registration roller pair is disposed substantially at a downstream end of the sheet feeding path 31. When the recording medium P fed from the sheet tray 30 and conveyed in the sheet feeding path 31 reaches the registration roller pair, the registration roller pair holds the recording medium P therebetween and halts the rotation thereof. Then, the registration roller pair starts to rotate again to synchronize movement of the recording medium P held therebetween with movement of the four-color toner image formed on the intermediate transfer belt 16 in the secondary transfer nip area. Subsequently, the recording medium P is conveyed toward the secondary transfer nip area.

The four-color toner image formed on the intermediate transfer belt 16 contacts the recording medium P in the secondary transfer nip area. Due to action of the secondary electric field and a nip pressure in the secondary transfer nip area, the four-color toner image is secondarily transferred onto the recording medium P. By being mixed with a white color of a surface of the recording medium P, the four-color toner image is developed to a full color toner image. After passing through the secondary transfer nip area, the recording medium P having the full color toner image on the surface thereof is stripped or separated by itself due to curvature of the secondary transfer roller 14 and the intermediate transfer belt 16. Then, the recording medium P is conveyed in a post transfer sheet conveyance path 33 that extends from the secondary transfer nip area formed between the drive roller 17 and the secondary transfer roller 14 to a fixing unit 34. Details of the fixing unit 34 will be described below.

After the secondary transfer of the toner image from the intermediate transfer belt 16 onto the recording medium P in the secondary transfer nip area, residual toner remains on the surface of the intermediate transfer belt 16. The residual toner is removed from the surface of the intermediate transfer belt 16 by the belt cleaning unit 22 that is disposed in contact with the outer surface of the intermediate transfer belt 16.

The cleaning backup roller 23 disposed inside the loop of the intermediate transfer belt 16 supports the belt cleaning unit 22 in cleaning of the intermediate transfer belt 16 from the inside of the loop.

The fixing unit 34 includes a fixing roller 34*a* and a pressure roller 34*b*. The fixing roller 34*a* includes a heat source such as a halogen lamp therein. The pressure roller 34*b* is disposed in contact with the fixing roller 34*a* with a given pressure and rotates with the fixing roller 34*a* by friction. A fixing nip area is formed between the fixing roller 34*a* and the pressure roller 34*b*.

The recording medium P conveyed in the post transfer sheet conveyance path 33 enters in the fixing unit 34 at a downstream end of the post transfer sheet conveyance path 33. The recording medium P in the fixing unit 34 is sandwiched by the fixing roller 34*a* and the pressure roller 34*b* in the fixing nip area. In the fixing nip area, a surface of the recording medium P, on which the full color toner image is formed with the toner unfixed to the recording medium P, is in contact with the fixing roller 34*a*. Due to application of heat and pressure, toner adhered to the toner image is melted, so that the full color toner image is fixed to the recording medium P.

The recording medium P that is output from the fixing unit 34 is conveyed in a post fixing sheet conveyance path 35. The post fixing sheet conveyance path 35 extends from the fixing unit 34 to a paper output roller pair 36. The recording medium P is held between the post fixing sheet conveyance path 35 and the paper output roller pair 36. Then, the recording medium P sandwiched by the paper output roller pair 36 is output to an upper surface of a top cover 50 of the body 1100 of the image forming apparatus 1000. The upper surface of the top tray 50 functions as a paper output tray.

Figure 2:
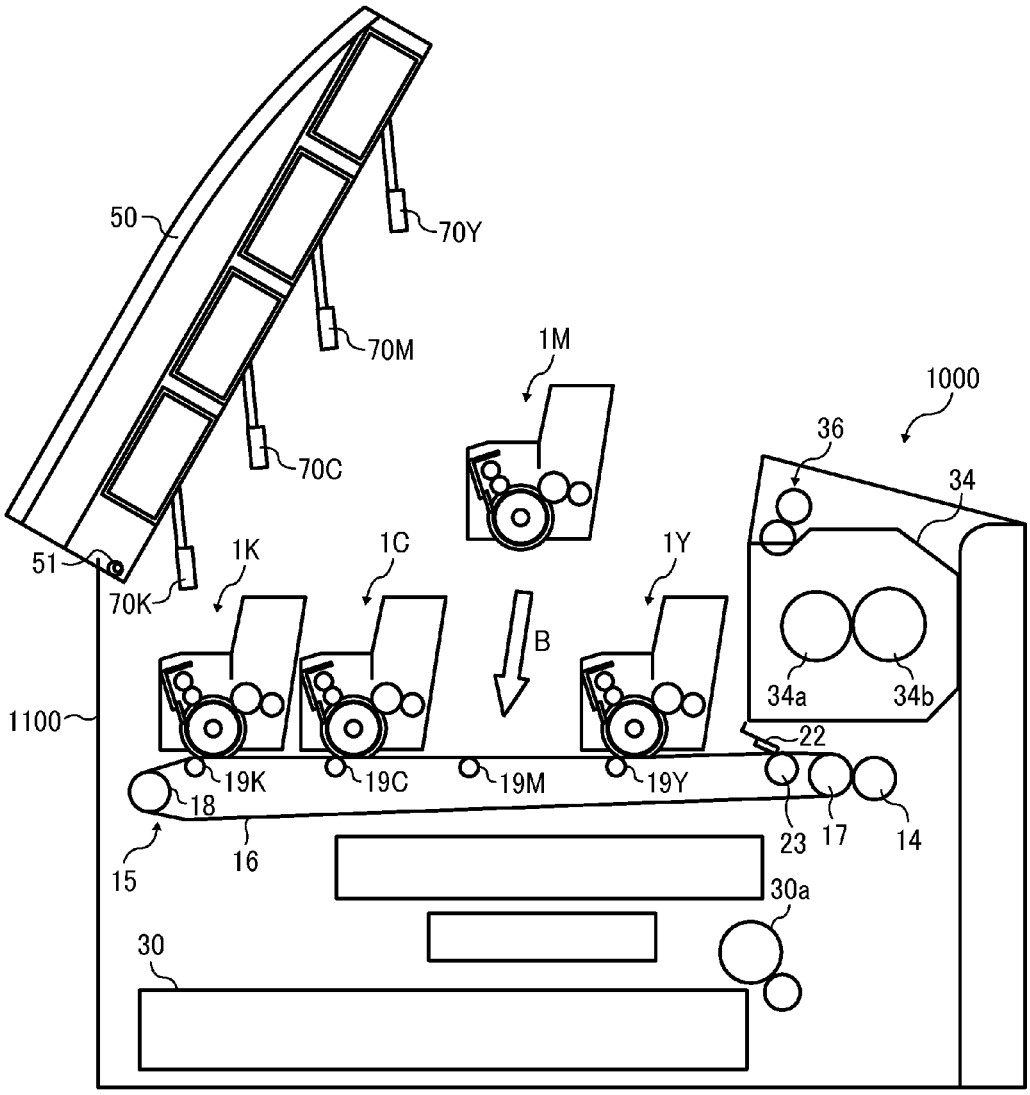
FIG. 2 is a vertical cross sectional view illustrating the image forming apparatus in a state that a top cover thereof is open.

Now, a description is given of functions of the top cover 50 with respect to the body 1100 of the image forming apparatus 1000, with reference to FIGS. 1 and 2.

FIG. 2 is a vertical cross sectional view illustrating the image forming apparatus 1000 in a state that the top cover 50 thereof is open.

The top cover 50 is rotatably supported about a shaft member 51 with respect to the body 1100 of the printer 1000. By rotating the top cover 50 counterclockwise in FIG. 1, the top cover 50 opens with respect to the body 1100 of the image forming apparatus 1000 as illustrated in FIG. 2. With this action, an upper portion of the body 1100 is widely shown and the image forming units 1Y, 1M, 1C, and 1K provided in the body 1100 of the image forming apparatus 1000 are exposed. With the top cover 50 being open to the body 1100 of the image forming apparatus 1000, the image forming units 1Y, 1M, 1C, and 1K can be removed therefrom. With this configuration, performance in replacement of the image forming unit 1 and/or in maintenance of the photoconductor 2 and the development unit 5 included in the image forming unit 1 can be enhanced.

The writing heads 70Y, 70M, 70C, and 70K are supported by the top cover 50. By remaining the top cover 50 open with respect to the body 1100 of the image forming apparatus 1000, the writing heads 70Y, 70M, 70C, and 70K are detached from the body 1100 to the outside thereof.

Now, a description is given of known drive units.

As an example, a drive unit disclosed in JP-2004-109766-A includes multiple driving shafts provided with engaging parts to engage with each end part of multiple image carriers aligned in one direction, and a string of gears for transmitting a driving force from a drive source to each driving shaft. The multiple driving shafts and the gears are disposed between side plates opposed to each other. The drive unit is detachably attachable to a body of an image forming apparatus. The drive unit employs a coupling mechanism as the engaging parts for engaging the image carriers and the driving shafts for driving. Consequently, the manufacturing cost increases and the structure becomes more complicated.

In another known drive unit, the rotary shaft of a photoconductor side gear or a gear provided on a photoconductor side and the rotary shaft of a drive unit side gear or a gear on a drive unit side are positioned to the same unit side plate. By meshing the photoconductor side gear and the drive unit side gear, a driving force is transmitted to a photoconductor to which the photoconductor side gear is attached. In this configuration, if the photoconductor side gear and the drive unit side gear are disposed along a radial direction, a large area or space is occupied for rotating the photoconductor side gear and the drive unit side gear in the radial direction. To address the circumstance, the rotary shaft of the photoconductor side gear and the rotary shaft of the drive unit side gear are positioned to separate unit side plates, so that the photoconductor side gear and the drive unit side gear are disposed overlapped in a thrust direction or an axial direction of the respective rotary shafts. However, since rotary shaft of the photoconductor side gear and the rotary shaft of the drive unit side gear are positioned to the separate unit side plates, it is likely that a distance between the rotary shaft of the photoconductor side gear and the rotary shaft of the drive unit side gear shifts from a target distance, due to processing accuracy and/or assembly error of parts included in the drive unit.

Figure 3:
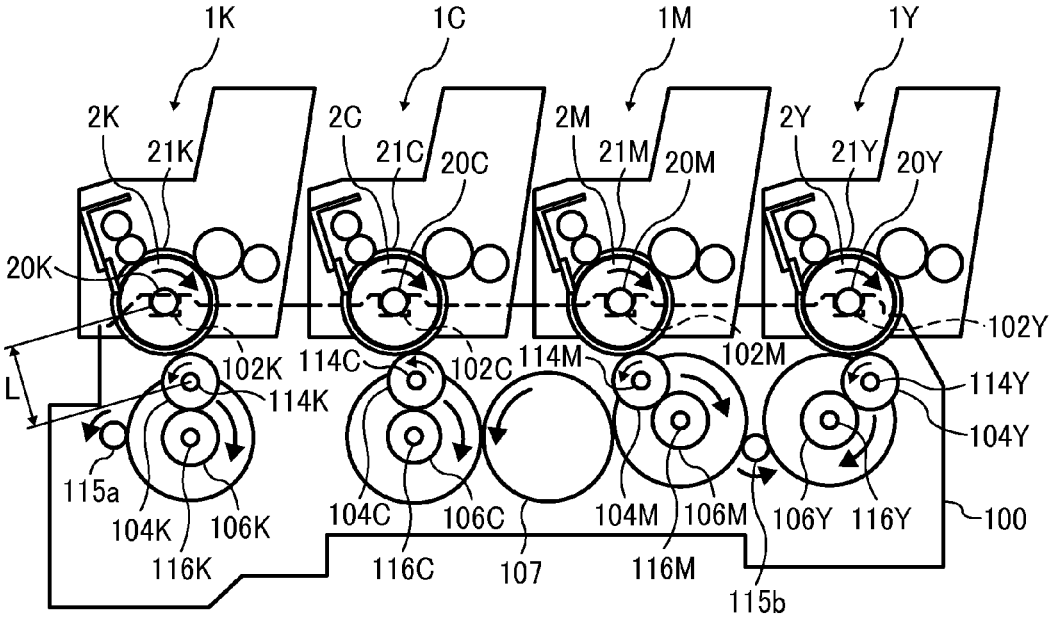
FIG. 3 is a vertical cross sectional view illustrating photoconductors and a photoconductor drive unit included in the image forming apparatus.

Now, a description is given of a structure and operations of a photoconductor drive unit 100 for driving the photoconductors 2 provided in the body 1100 of the image forming apparatus 1000, with reference to FIG. 3.

FIG. 3 is a vertical cross sectional view illustrating the photoconductors 2Y, 2M, 2C, and 2K and the photoconductor drive unit 100 included in the image forming apparatus 1000.

In a state in which the image forming units 1Y, 1M, 1C, and 1K are attached to the body 1100, photoconductor center shafts 20K, 20C, 20M, and 20Y are positioned to positioning portions 102K, 102C, 102M, and 102Y, respectively, in the photoconductor drive unit 100. The photoconductor center shafts 20K, 20C, 20M, and 20Y function as rotary shafts of the photoconductors 2K, 2C, 2M, and 2Y, respectively, and the positioning portions 102K, 102C, 102M, and 102Y function as holding portions. Accordingly, the image forming units 1Y, 1M, 1C, and 1K are positioned in the body 1100 of the image forming apparatus 1000.

The photoconductors 2K, 2C, 2M, and 2Y are driven by more than one drive source 105. The configuration of the photoconductor drive unit 100 as illustrated in FIG. 3 is driven by two drive sources 105*a* and 105*b* (see FIG. 5).

In the photoconductor drive unit 100, a drive gear 104K is meshed with a relay gear 106K and a photoconductor gear 21K, and the photoconductor gear 21K is attached to the same shaft as the photoconductor 2K. With this configuration, the drive source 105*a* transmits a driving force to the drive gear 104K via the relay gear 106K, and then to the photoconductor gear 21K. Thus, the photoconductor 2K is rotated.

Further, in the photoconductor drive unit 100, a drive gear 104M is meshed with a relay gear 106M and a photoconductor gear 21M, and the photoconductor gear 21M is attached to the same shaft as the photoconductor 2M. Similarly, a drive gear 104Y is meshed with a relay gear 106Y and a photoconductor gear 21Y, and the photoconductor gear 21Y is attached to the same shaft as the photoconductor 2Y. With this configuration, the drive source 105*b* transmits a driving force to the drive gears 104M and 104Y via the relay gears 106M and 106Y, respectively, and then to the photoconductor gears 21M and 21Y, respectively. Thus, the photoconductors 2M and 2Y are rotated.

Further, in the photoconductor drive unit 100, a relay gear 107 is meshed with the relay gear 106M and a relay gear 106C, a drive gear 104C is meshed with the relay gear 106C and a photoconductor gear 21C, and the photoconductor gear 21C is attached to the same shaft as the photoconductor 2C. Thus, the photoconductor 2C is rotated.

Figure 4:
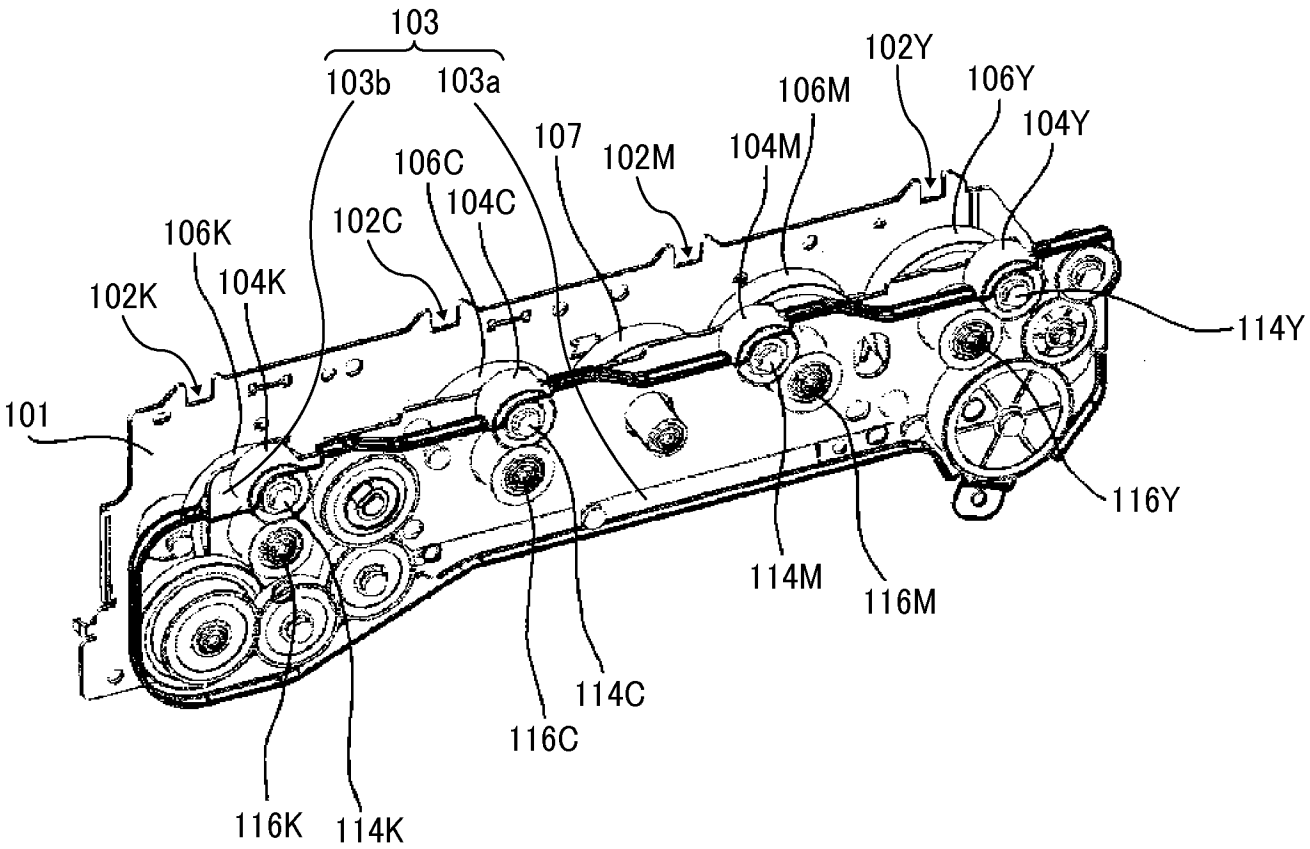
FIG. 4 is a perspective view illustrating the photoconductor drive unit.

Now, a description is given of the detailed configuration of the photoconductor drive unit 100. FIG. 4 is a perspective view illustrating the photoconductor drive unit 100, with reference to FIG. 4.

The photoconductor drive unit 100 that functions as a unit side plate includes a photoconductor positioning member 101 and a drive gear holder 103. The photoconductor positioning member 101 functions as a first holder. In the present embodiment, the drive gear holder 103 includes two drive gear holding members 103*a* and 103*b*. The drive gear holding member 103*a* functions as a second holder, and the drive gear holding member 103*b* functions as a fixing member to which the photoconductor positioning member 101 and the drive gear holding member 103*a* are fixed. The drive gear holding member 103*b* is disposed at a position between the photoconductor positioning member 101 and the drive gear holding member 103*a* or at a position outside the photoconductor positioning member 101 and the drive gear holding member 103*a*. Specifically, the photoconductor drive unit 100 is a unit integrally including at least the photoconductor positioning member 101 and the drive gear holding member 103*a*, and the drive gear holding member 103*b* may be included therein.

The photoconductor positioning member 101 includes the positioning portions 102K, 102C, 102M, and 102Y for holding and positioning the photoconductor center shafts 20K, 20C, 20M, and 20K of the photoconductor gears 21K, 21C, 21M, and 21Y, respectively. The drive gear holding member 103*a* holds rotary shafts 114K, 114C, 114M, and 114Y of the drive gears 104K, 104C, 104M, and 104Y.

Further, the photoconductor gears 21K, 21C, 21M, and 21Y are disposed to overlap the drive gears 104K, 104C, 104M, and 104Y, respectively, in the thrust direction of the rotary shaft of each of the photoconductor gears 21K, 21C, 21M, and 21Y and the rotary shaft of each of the drive gears 104K, 104C, 104M, and 104Y. By so doing, an increase in space occupied for rotation of those gears is prevented. Accordingly, the photoconductor drive unit 100 includes a layered structure formed with the photoconductor positioning member 101 and the drive gear holding members 103*a* and 103*b*. With this layered structure, strength of the photoconductor drive unit 100 increases. Accordingly, vibration of the photoconductor drive unit 100 caused by rotations of the gears decreases.

The photoconductor drive unit 100 transmits a driving force from the drive source 105 to the photoconductor 2 via gears such as the photoconductor gear 21 meshed with the drive gear 104. Different from the above-described known drive unit that employs the coupling mechanism, the photoconductor drive unit 100 can prevent an increase in costs and a complicated structure.

In the image forming apparatus 1000 according to the present embodiment, a distance L is determined as follows. The distance L is an extent of space from any one of the drive gears 104K, 104C, 104M, and 104Y to a corresponding one of the photoconductor gears 21K, 21C, 21M, and 21Y in the image forming apparatus 1000. If the distance L is smaller than a target distance, a tip of a tooth or teeth of the drive gear 104 (i.e., the drive gears 104K, 104C, 104M, and 104Y) contacts a root of a tooth or teeth of the photoconductor gear 21 (i.e., the photoconductor gears 21K, 21C, 21M, and 21Y), or vice versa. This can cause abnormal wear or damage and/or an increase in load on driving of both the drive gear 104 and the photoconductor gear 21. By contrast, if the distance L is greater than the target distance, vibration occurs when driving the gears. Consequently, image failure such as banding may be caused.

To address the above-described circumstance, the photoconductor drive unit 100 according to the present embodiment employs the configuration in which the photoconductor positioning member 101 and the drive gear holding members 103*a* and 103*b* are disposed at variable relative positions. In other words, the relative positions of the photoconductor positioning member 101 and the drive gear holding members 103*a* and 103*b* in the photoconductor drive unit 100 are adjustable. Further, when the photoconductor drive unit 100 is assembled, the relative position between the photoconductor positioning member 101 and the drive gear holding members 103*a* and 103*b* is adjusted so that the distance L is set to the target distance. After adjustment of the relative position therebetween has been finished, the photoconductor positioning member 101 and the drive gear holding members 103*a* and 103*b* are fixed to each other.

In the present embodiment, the photoconductor drive unit 100 has the configuration in which the photoconductor center shafts 20K, 20C, 20M, and 20Y are directly supported by and positioned to the drive gear holding members 103*a* and 103*b* to which the drive gears 104K, 104C, 104M, and 104Y are attached. Therefore, the photoconductor drive unit 100 having this configuration is less affected by accumulated errors due to processing accuracy and/or assembly error of parts included in the photoconductor drive unit 100 when compared with a configuration in which the photoconductor center shafts 20K, 20C, 20M, and 20Y are supported by and positioned to the body 1100. In addition, the photoconductor 2 and the photoconductor center shaft 21 are directly positioned to the photoconductor drive unit 100. Accordingly, without providing a complicated mechanism such as a coupling mechanism, adverse effect to the photoconductor drive unit 100 caused by the accumulated errors as described above can be reduced.

Figure 5:
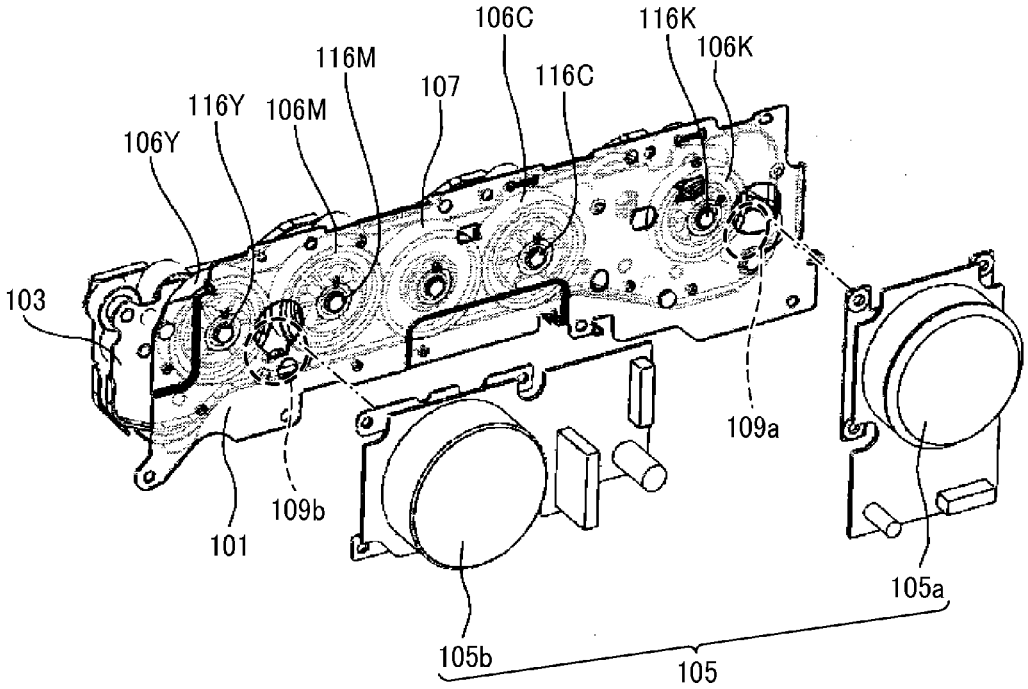
FIG. 5 is a perspective view illustrating drive sources to be positioned to the photoconductor drive unit.

Now, a description is given of positioning of the drive sources 105*a* and 105*b* in the photoconductor drive unit 100, with reference to FIG. 5. FIG. 5 is a perspective view illustrating the drive sources 105*a* and 105*b* to be positioned to the photoconductor drive unit 100.

The photoconductor positioning member 101 includes drive source positioning portions 109*a* and 109*b* to be used for positioning the drive sources 105*a* and 105*b* to the photoconductor positioning member 101. Further, respective relay gear rotary shafts 116K, 116*c*, 116M, and 116Y of the relay gears 106K, 106C, 106M, and 106Y are supported by the photoconductor positioning member 101. The relay gear 106K meshes with a gear 115*a* attached to the drive shaft of the drive source 105*a* and the relay gears 106M and 106Y mesh with a gear 115*b* attached to the drive shaft of the drive source 105*b* as illustrated in FIG. 3. The relay gear 106C is connected to the relay gear 106M via the relay gear 107 that is meshed with the relay gears 106C and 106M as illustrated in FIG. 3. According to this configuration, the respective distances between the gears 115*a* and 115*b* of the drive sources 105*a* and 105*b* and the relay gears 106K, 106M, and 106Y are determined by the same part or member. As a result, the driving forces from the drive sources 105*a* and 105*b* can be transmitted to the relay gears 106K, 106M, and 106Y accurately.

To enhance printing quality of the image forming apparatus 1000, the photoconductors 2K, 2C, 2M, and 2Y are maintained at the respective positions during the printing operation without leaving from the photoconductor positioning portions 102K, 102C, 102M, and 102Y, that is, the photoconductors 2K, 2C, 2M, and 2Y contact the intermediate transfer belt 16 stably.

Figure 6:
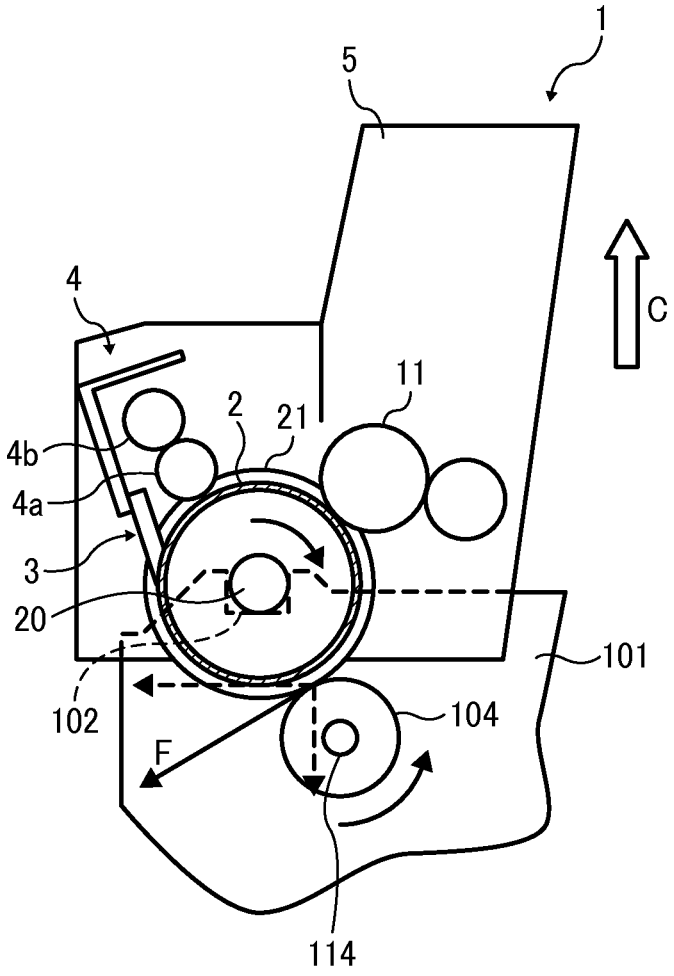
FIG. 6 is a vertical cross sectional view illustrating an image forming unit and the photoconductor drive unit, indicating a direction of a tangential force on a photoconductor gear having a component opposite to a removing direction of the image forming unit when the photoconductor gear receives a driving force from a drive gear.

Now, a description is given of a tangential force F applied to the photoconductor gear 21, with reference to FIG. 6.

The tangential force F in FIG. 6 has a component force opposite to a direction to which the image forming unit 1 (i.e., the image forming units 1K, 1C, 1M, and 1Y) is detached. As illustrated in FIG. 6, in the configuration of the image forming apparatus 1000 according to the present embodiment, the photoconductor gear 21 (i.e., the photoconductor gears 21K, 21C, 21M, and 21Y) and the drive gear 104 (i.e., the drive gears 104K, 104C, 104M, and 104Y) are so disposed that the above-described tangential force F is applied to the photoconductor gear 21 when the photoconductor gear 21 receives a driving force transmitted by the drive gear 104 held by the rotary shaft 114. By so doing, when the photoconductor gear 21 meshes and receives the driving force transmitted by the drive gear 104, the photoconductor center shaft 20 is pressed against the photoconductor positioning portion 102. Accordingly, the image forming unit 1 is prevented from lifting up while the photoconductor 2 is rotating.

According to this configuration, the parts or units used to drive to rotate the photoconductors 2K, 2C, 2M, and 2Y are also used to prevent the image forming units 1K, 1C, 1M, and 1Y from rising from the photoconductor positioning member 101. As a result, the number and layout of parts to be employed for preventing the image forming units 1K, 1C, 1M, and 1Y from lifting up from the photoconductor positioning member 101 can be reduced to the minimum.

Next, a description is given of a structure and function of a drive unit adjuster 108 provided to the photoconductor drive unit 100, with reference to FIGS. 7, 8A through 8C, and 9(*a*) through 9(*c*).

Figure 7:
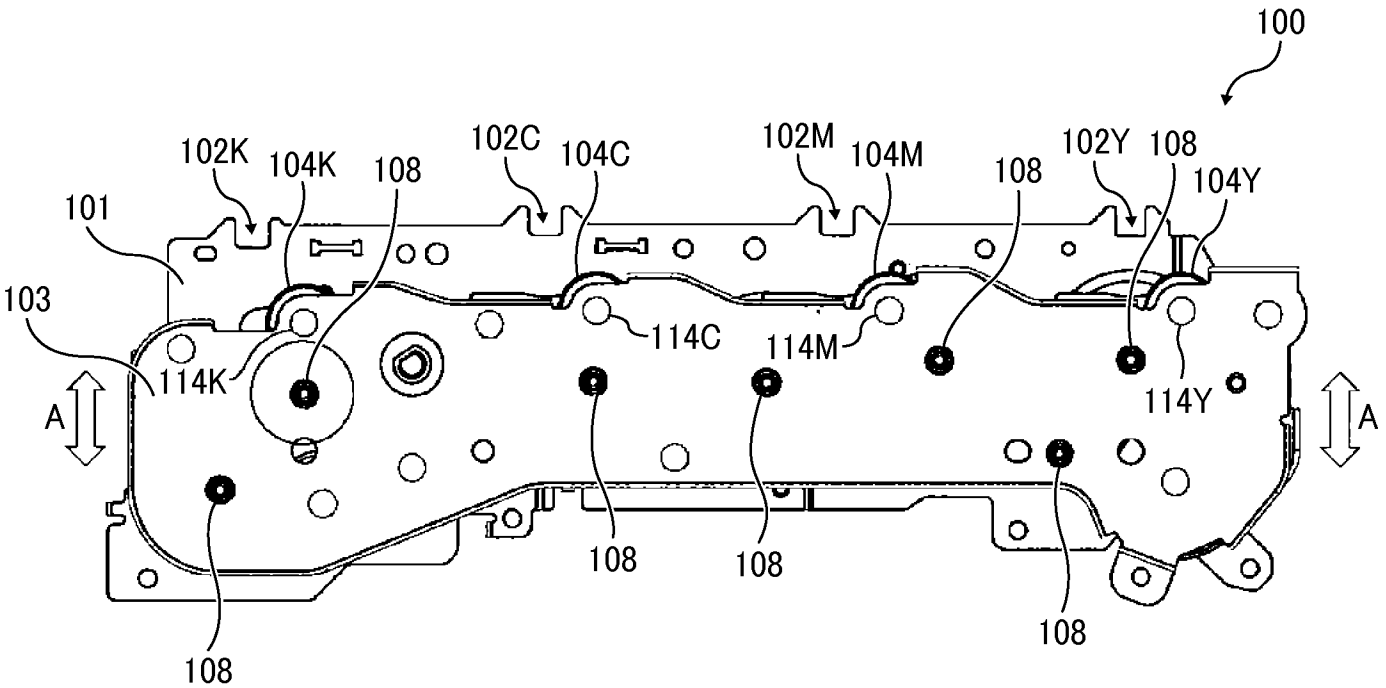
FIG. 7 is a vertical cross sectional view illustrating a drive unit adjuster provided to the photoconductor drive unit.
Figure 8A:
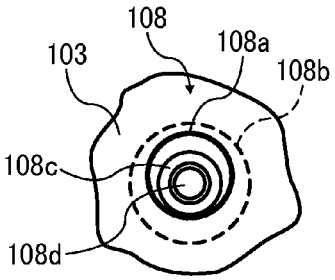
FIG. 8A through 8C are enlarged cross sectional views illustrating the drive unit adjuster and units around the drive unit adjuster.
Figure 8B:
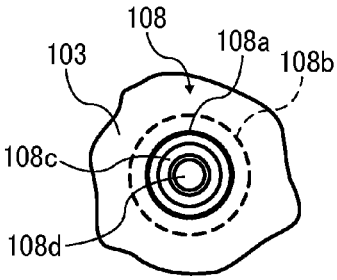
Figure 8C:
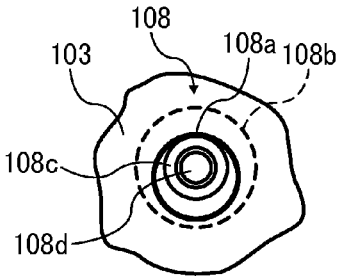
Figure 9:
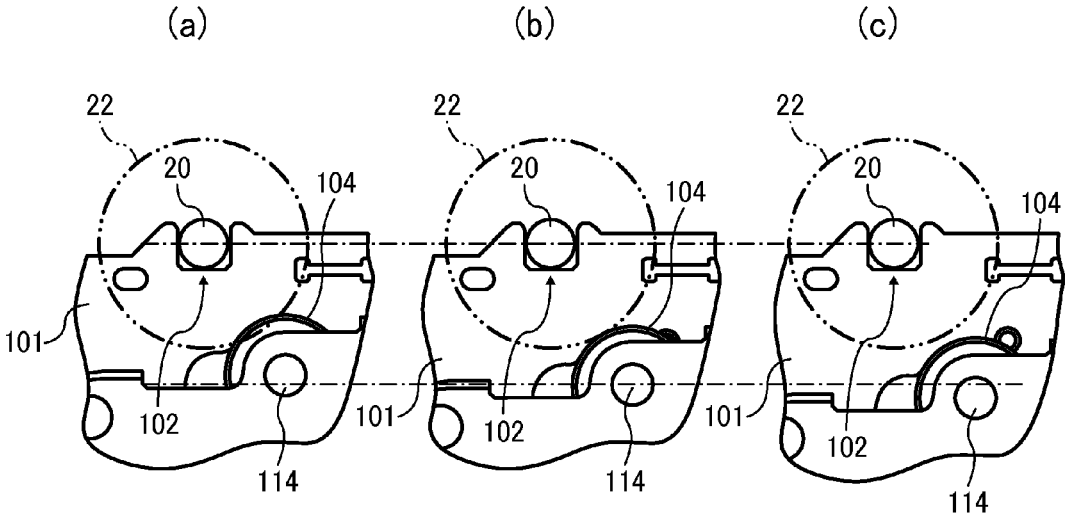
FIG. 9(*a*) through 9(*c*) are vertical cross sectional views illustrating a distance between shafts of the photoconductor gear and the drive gear.

FIG. 7 is a vertical cross sectional view illustrating multiple drive unit adjusters 108 each functioning as an adjuster. FIGS. 8A through 8C are enlarged cross sectional views illustrating the drive unit adjuster 108 and units disposed around the drive unit adjuster 108. FIGS. 9(*a*) through 9(*c*) are vertical cross sectional views illustrating a distance between the rotary shaft of the photoconductor gear 21 and the rotary shaft of the drive gear 104.

As illustrated in FIG. 7, the photoconductor drive unit 100 includes the drive unit adjusters 108. Each of the drive unit adjusters 108 includes an adjustment opening 108*a*, an adjustment shaft 108*b*, and an adjustment boss 108*c* including an opening 108*d*. The adjustment openings 108*a* are formed on the drive gear holding members 103*a* and 103*b*. The adjustment shaft 108*b* is formed on the photoconductor positioning member 101. The adjustment boss 108*c* is provided to the tip of the adjustment shaft 108*b*. The opening 108*d* is formed at the center of the adjustment boss 108*c* for fixing a screw. It is to be noted that the adjustment shaft 108*b* in whole or in part thereof also functions as a center shaft of the relay gear 106. Accordingly, the adjustment shaft 108*b* functions as a fixer that fixes the photoconductor positioning member 101 and the drive gear holding member 103*a* as well as an adjuster that adjusts the relative position of the photoconductor positioning member 101 and the drive gear holding member 103*a*.

Now, FIGS. 8A through 8C, and 9(*a*) through 9(*c*) show the drive unit adjuster 108 after adjustment of the relative positions of the photoconductor positioning member 101 and the drive gear holding members 103*a* and 103*b* and another state the distance between the rotary shaft of the drive gear 104 and the rotary shaft of the photoconductor gear 21.

FIGS. 8B and 9(*b*) show that the distance between the rotary shaft of the drive gear 104 and the rotary shaft of the photoconductor gear 21 is in a normal distance. That is, a pitch circle of the drive gear 104 and a pitch circle of the photoconductor gear 21 are disposed in contact with each other. To change the distance between the rotary shafts from the normal distance for some reason, the adjustment boss 108*c* is shifted with respect to the adjustment opening 108*a*. By so doing, the relative position between the photoconductor positioning member 101 by which the photoconductor center shaft 20 is supported and positioned and the drive gear holding members 103*a* and 103*b* to which the drive gear 104 is attached changes. Accordingly, the distance between the rotary shafts can be adjusted.

FIG. 8A shows a positional relation of the adjustment opening 108*a* and the adjustment boss 108*c* in the state that the distance between the rotary shaft of the drive gear 104 and the rotary shaft of the photoconductor gear 21 is out of the normal distance. By contrast, FIG. 8C shows a positional relation of the adjustment opening 108*a* and the adjustment boss 108*c* in the state that the distance between the rotary shaft of the drive gear 104 and the rotary shaft of the photoconductor gear 21 is out of the normal distance.

In FIGS. 8A through 8C, the distance of the rotary shafts is adjusted by shifting the adjustment boss 108*c* in a vertical direction with respect to the adjustment opening 108*a*. However, a moving direction of the rotary shafts is not limited thereto. For example, the distance of the rotary shafts can be adjusted by shifting the adjustment boss 108*c* in a horizontal direction.

After adjustment of the relative position between the photoconductor positioning member 101 and the drive gear holding members 103*a* and 103*b*, the photoconductor positioning member 101 and the drive gear holding members 103*a* and 103*b* are attached to each other by screws through the opening 108*d* provided to the adjustment boss 108*c*. Thus, the photoconductor positioning member 101 and the drive gear holding members 103*a* and 103*b* are fixed to each other. Accordingly, assembly of the photoconductor drive unit 100 is completed.

As described above, by using the same shaft to function for adjusting the relative positions of the photoconductor positioning member 101 and the drive gear holding members 103*a* and 103*b*, rotating the gears such as the drive gear 104 and the photoconductor gear 21, and fixing the photoconductor positioning member 101 and the drive gear holding members 103*a* and 103*b*, the photoconductor drive unit 100 can be assembled with high accuracy with the minimum number of parts and components.

Figure 10:
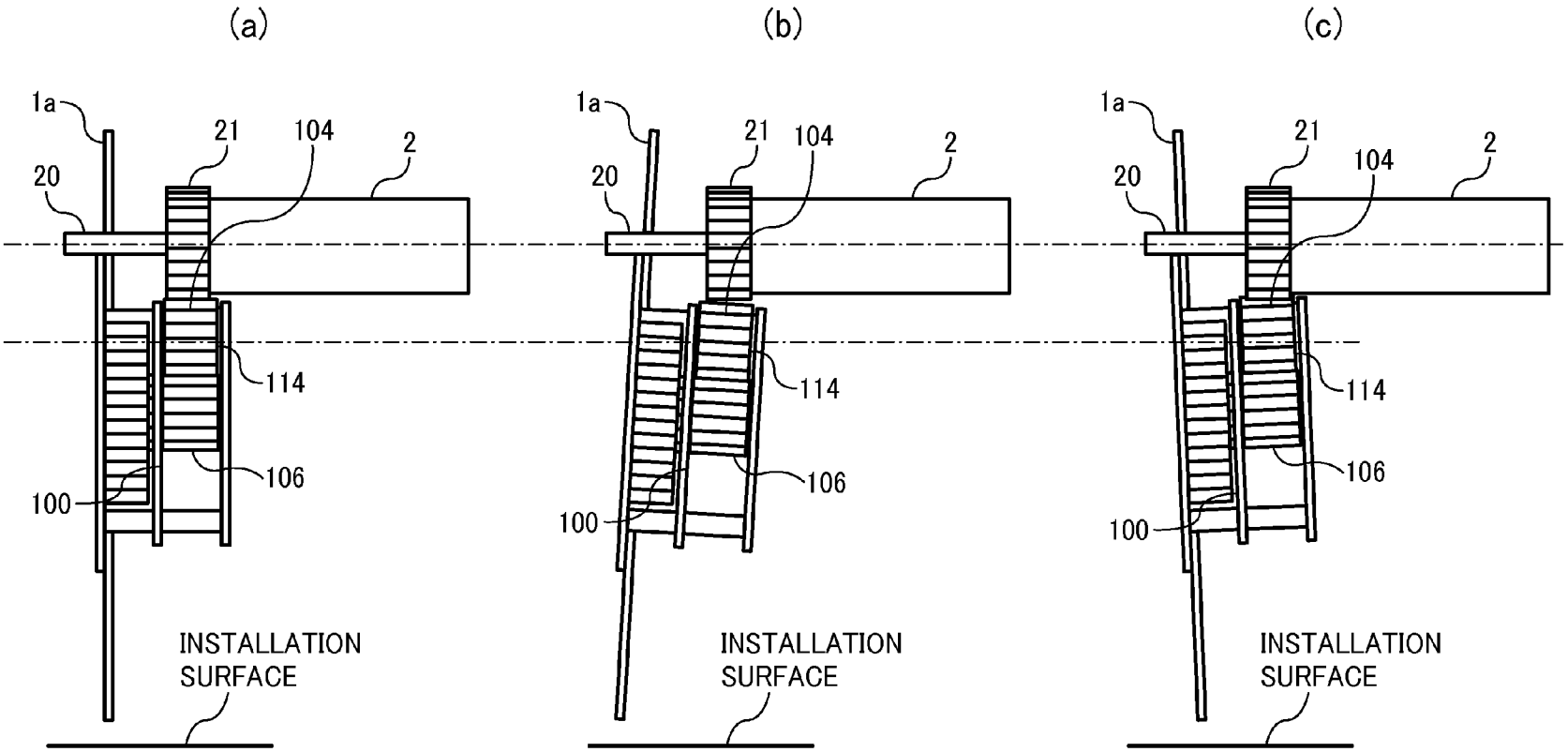
FIG. 10(*a*) through 10(*c*) are vertical cross sectional views illustrating a state in which the photoconductor drive unit and the photoconductor are attached to the image forming apparatus, viewed from a front of the image forming apparatus.

Next, a description is given of changes in distance between the drive gear 104 and the photoconductor gear 21 depending on a frame condition of the body 1100 of the image forming apparatus 1000, with reference to FIG. 10(*a*) through 10(*c*).

FIG. 10(*a*) through 10(*c*) are vertical cross sectional views illustrating a state in which the photoconductor drive unit 100 and the photoconductors 2 are attached to the body 1100 of the image forming apparatus 1000, viewed from a front of the image forming apparatus 1000.

As illustrated in FIG. 10(*a*) through 10(*c*), the image forming apparatus 1000 includes a side panel frame 1*a* in the body 1100 thereof. If there is no processing accuracy and/or assembly error, the side panel frame 1*a* stands straight on an installation surface perpendicular to an installation surface as illustrated in FIG. 10(*a*).

However, if the side panel frame 1*a* has any processing accuracy and/or assembly error, the side panel frame 1*a* may be disposed in a tilted manner with respect to the installation surface, as illustrated in FIGS. 10(*b*) and 10(*c*). At this time, the parallelism is lost between the photoconductor drive unit 100 and the photoconductor 2, as illustrated in FIGS. 10(*b*) and 10(*c*). As a result, the distance between the drive gear 104 and the photoconductor gear 21 becomes greater as shown in FIG. 10(*b*) or smaller as shown in FIG. 10(*c*) than the target distance of the rotary shafts.

To address the above-described circumstance, the photoconductor drive unit 100 having the configuration shown in FIGS. 7, 8A through 8C, and 9(*a*) through 9(*c*) can be applied to correct the distance of the rotary shafts of the drive gear 104 and the photoconductor gear 21.

Specifically, when assembling the photoconductor drive unit 100, the relative position of the photoconductor positioning member 101 and the drive gear holding members 103*a* and 103*b* can be changed while adjusting such that the distance between the rotary shaft of the photoconductor gear 21 and the rotary shaft of the drive gear 104 is set to the target distance. Accordingly, the photoconductor gear 21 and the drive gear 104 can be prevented from being assembled while the distance between the rotary shafts of the photoconductor gear 21 and the drive gear 104 is out of the target distance due to processing accuracy and/or assembly error of the parts in the image forming apparatus 1000. If the distance between the rotary shafts of the photoconductor gear 21 and the drive gear 104 is shifted from the target distance, vibration is created when the photoconductor gear 21 and the drive gear 104 are driven to rotate. Consequently, image failure such as banding may be caused due to the vibration. The configuration of the photoconductor drive unit 100 can prevent such image failure due to vibration. Further, the photoconductor gear 21 and the drive gear 104 can be free from abnormal wear or damage and/or an increase in load on driving thereof caused by the distance between the rotary shafts of the photoconductor gear 21 and the drive gear 104 is set smaller than the target distance.

Next, a description is given of adjustment of the relative position of the photoconductor positioning member 101 and the drive gear holding members 103*a* and 103*b* with a fitting tool 200.

Figure 11:
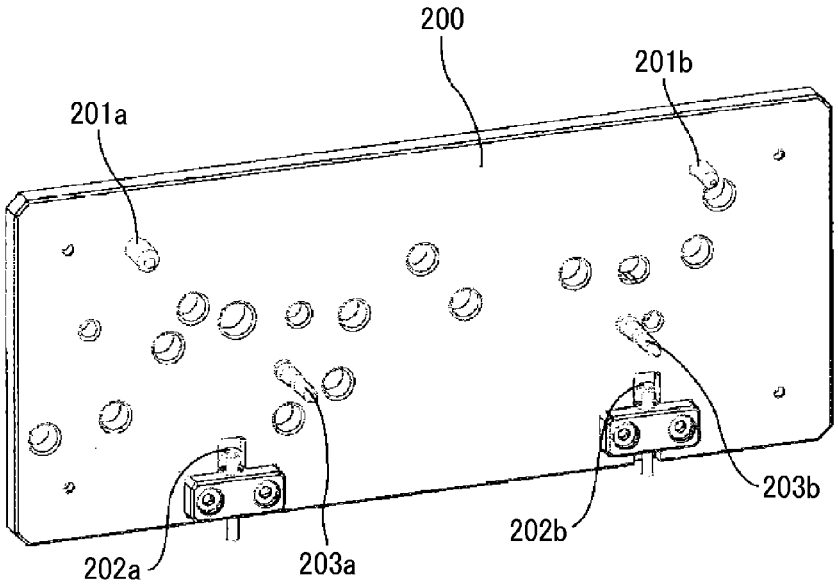
FIG. 11 is a perspective view illustrating an outer appearance of a positioning tool.
Figure 12:
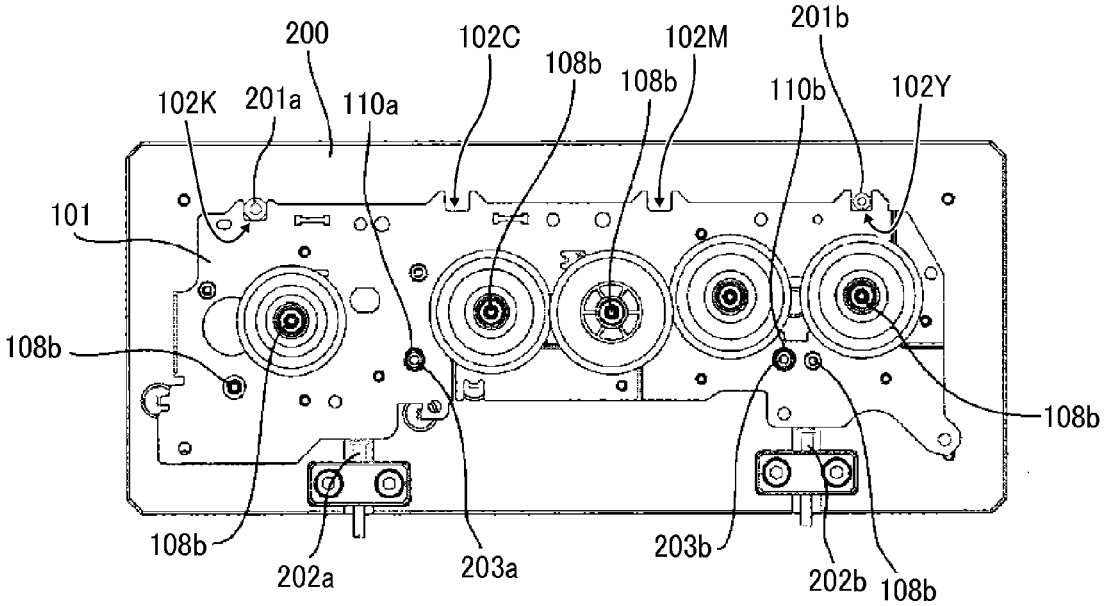
FIG. 12 is a cross sectional view illustrating a state in which a photoconductor positioning member is attached to the positioning tool.
Figure 13:
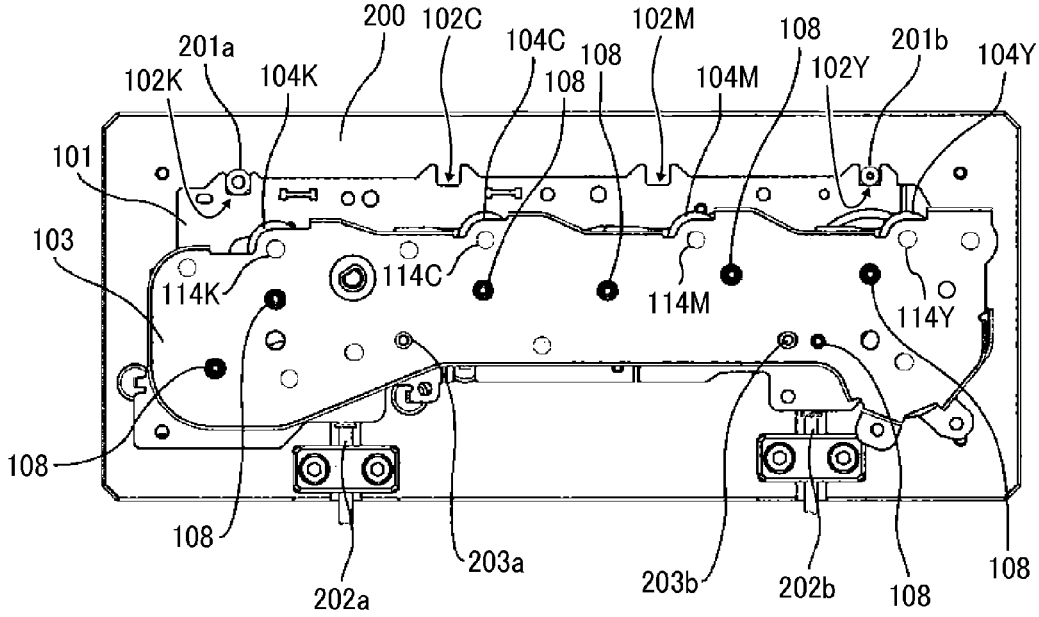
FIG. 13 is a cross sectional view illustrating a state in which the photoconductor positioning member and drive gear holders are attached to the positioning tool.

FIG. 11 is a perspective view illustrating an outer appearance of the fitting tool 200. FIG. 12 is a cross sectional view illustrating a state in which photoconductor positioning member 101 is attached to the fitting tool 200. FIG. 13 is a cross sectional view illustrating a state in which the photoconductor positioning member 101 and the drive gear holder 103 (i.e., drive gear holding members 103*a* and 103*b*) are attached to the fitting tool 200.

The fitting tool 200 includes locating pins 201*a* and 201*b*, biasing members 202*a* and 202*b*, and retaining pins 203*a* and 203*b*. The locating pins 201*a* and 201*b* function as contact members to position the photoconductor positioning member 101 on the fitting tool 200. The biasing members 202*a* and 202*b* bias the photoconductor positioning member 101 toward the locating pins 201*a* and 201*b*. The retaining pins 203*a* and 203*b* functioning as positioning shafts hold and position the drive gear holding members 103*a* and 103*b*. The locating pin 201*a* has the same diameter as that of the photoconductor center shaft 20. The locating pin 201*b* has a diameter smaller than the locating pin 201*a*.

In assembling the photoconductor drive unit 100, the photoconductor positioning member 101 is firstly positioned to the fitting tool 200 with the biasing members 202*a* and 202*b*, as illustrated in FIG. 12.

The drive gear holding members 103*a* and 103*b* are provided with positioning holes 110*a* and 110*b*, respectively, functioning as positioning holes through which the retaining pins 203*a* and 203*b* of the fitting tool 200 are inserted, respectively. In the state in which the photoconductor positioning member 101 is positioned to the fitting tool 200, as the retaining pins 203*a* and 203*b* are inserted into the positioning holes 110*a* and 110*b*, respectively, the drive gear holding members 103*a* and 103*b* are set onto the fitting tool 200.

The locating pins 201*a* and 201*b* and the retaining pins 203*a* and 203*b* are disposed on the fitting tool 200 such that the distance between the rotary shaft of the photoconductor gear 21 and the rotary shaft of the drive gear 104 can be set to the target distance when the photoconductor positioning member 101 and the drive gear holding members 103*a* and 103*b* are set to the fitting tool 200.

With the photoconductor positioning member 101 and the drive gear holding members 103*a* and 103*b* set to the fitting tool 200, the photoconductor positioning member 101 and the drive gear holding members 103*a* and 103*b* are screwed with the screw opening 108*d* provided to the drive unit adjuster 108. By so doing, the respective relative positions are fixed, and therefore the distance between the rotary shaft of the photoconductor gear 21 and the rotary shaft of the drive gear 104 can be maintained to the target distance. Thus, by using the fitting tool 200 in assembly of the photoconductor drive unit 100, the assembly can be performed with high accuracy in positioning.

Alternatively, the fitting tool 200 can be an inserting type tool in which the locating pins 201*a* and 201*b* is detachably attachable to the fitting tool 200. With this structure, the locating pins 201*a* and 201*b* can be replaced easily. Without changing the sizes of the locating pins 201*a* and 201*b* in a horizontal direction in FIGS. 12 and 13, the sizes thereof in a vertical direction in the drawings by replacement of the locating pins 201*a* and 201*b*. By so doing, the relative position of the photoconductor positioning member 101 and the drive gear holding members 103*a* and 103*b* is adjusted. Accordingly, the distance between the rotary shaft of the photoconductor gear 21 and the rotary shaft of the drive gear 104 can be finely adjusted.

Figure 14:
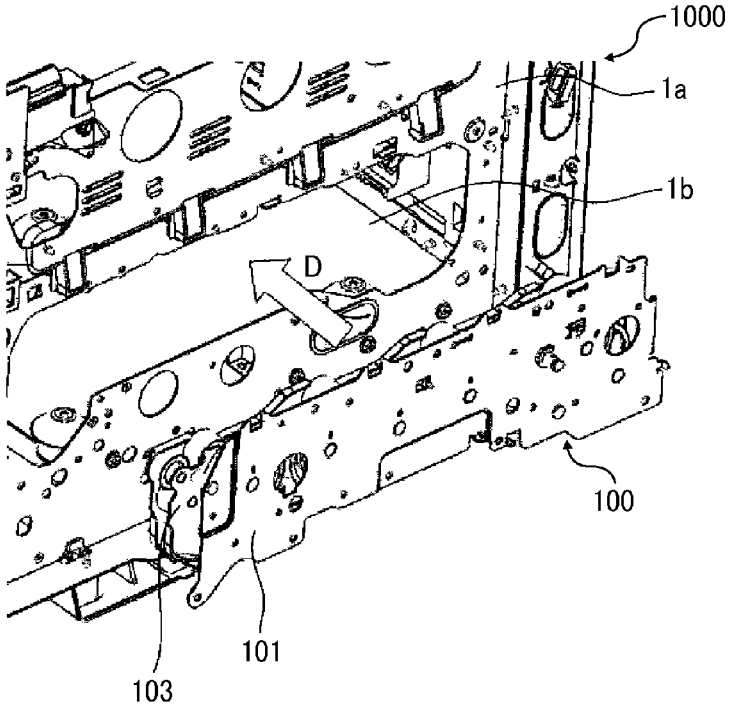
FIG. 14 is a perspective view illustrating how to attach the photoconductor drive unit to the image forming apparatus.

Next, a description is given of attachment of the photoconductor drive unit 100 to the body 1100 of the image forming apparatus 1000, with reference to FIG. 14.

As illustrated in FIG. 14, the side panel frame 1*a* of the body 1100 of the image forming apparatus 1000 has an opening 1*b*. The opening 1*b* is greater than an outline of the drive gear holder 103 (i.e., the drive gear holding members 103*a* and 103*b*) provided in the photoconductor drive unit 100. When attaching the photoconductor drive unit 100 to the body 1100, the drive gear holding members 103*a* and 103*b* are inserted into the image forming apparatus 1000 through the opening 1*b*. Then, the photoconductor positioning member 101 is fixed to the side panel frame 1*a* with screw, for example. With this configuration, the photoconductor drive unit 100 can be replaced and attached to the body 1100 of the image forming apparatus 1000 with a direct access thereto from outside the body 1100 of the image forming apparatus 1000. Accordingly, performance in service and maintenance of the image forming apparatus 1000 can be enhanced.

In a case in which either one of the photoconductor positioning member 101 and the drive gear holding members 103*a* and 103*b* is formed integrally with the body 1100 of the image forming apparatus 1000, when the distance between the rotary shaft of the photoconductor gear 21 and the rotary shaft of the drive gear 104 is adjusted, an operator hugs the body 1100 of the image forming apparatus 1000 to proceed the adjustment, which results in poor working performance.

By contrast, the image forming apparatus 1000 according to the present embodiment employs the configuration in which the photoconductor drive unit 100 having the photoconductor positioning member 101 and the drive gear holding members 103*a* and 103*b* integrally provided is detachably attachable to the body 1100 of the image forming apparatus 1000. According to this configuration, an operator can easily adjust the distance between the rotary shaft of the photoconductor gear 21 and the rotary shaft of the drive gear 104 at a different place from the body 1100 of the image forming apparatus 1000.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

a body;

an image carrier provided in the body and configured to form an image thereon;

a first gear configured to transmit a rotation driving force to the image carrier;

a first rotary shaft to which the image carrier and the first gear are attached;

a second gear configured to mesh with the first gear and transmit the rotation driving force to the first gear;

a second rotary shaft to which the second gear is attached;

a drive source configured to drive to rotate the image carrier via the first gear and the second gear;

a first holder to hold the first rotary shaft of the first gear; and a second holder to hold the second rotary shaft of the second gear, wherein a relative position between the first holder and the second holder is adjustable.

2. The image forming apparatus according to claim 1, wherein the first holder and the second holder with the relative position adjusted and integrally fixed to each other function as a unit detachably attachable to the body.

3. The image forming apparatus according to claim 1, further comprising a relay gear having a rotary shaft and configured to transmit a driving force to the second gear, wherein the rotary shaft of the relay gear is held by the first holder, wherein the relay gear and the second gear are disposed to overlap each other in a thrust direction.

4. The image forming apparatus according to claim 1, further comprising an adjuster disposed on the first holder and the second holder and configured to adjust the relative position between the first holder and the second holder, wherein the adjuster functions as a fixer to fix the first holder and the second holder.

5. The image forming apparatus according to claim 1, further comprising a fitting tool configured to be used to attach the first holder and the second holder, the fitting tool comprising a contact member and a positioning shaft;

wherein the first holder has a holding portion to hold the first rotary shaft, wherein the second holder has a positioning hole, wherein the relative position between the first holder and the second holder is positioned by contacting the holding portion of the first holder with the contact member of the fitting tool and fixing the first holder and the second holder with the positioning shaft of the fitting tool passing through the positioning hole formed on the second holder.

6. The image forming apparatus according to claim 5, wherein the contact member is detachably attached to the fitting tool, wherein the relative position of the first holder and the second holder is adjusted by replacing the contact member.

7. The image forming apparatus according to claim 1, further comprising a development device to develop the image formed on the image carrier, wherein at least the image carrier, the first gear, and the development device form a process cartridge detachably attached to the body.

8. The image forming apparatus according to claim 1, further comprising a drive unit having at least one of the first holder, the second holder, the second gear, and the drive source, and detachably attachable to the body.

9. The image forming apparatus according to claim 7, wherein the process cartridge is attached to the body, wherein a component force opposite to a direction to which the process cartridge is detached from the body to the first gear when the image carrier is driven to rotate with the first gear meshing the second gear.

10. The image forming apparatus according to claim 8, further comprising a fixing member to fix the first holder and the second holder, wherein the fixing member is disposed at either one of a position between the first holder and the second holder and a position outside the first holder and the second holder, wherein the drive unit has a layered structure formed with a first layer of the first holder and the second holder, a second layer of the second holder and the fixing member, and a third layer of the first holder and the fixing member, respectively fixed to each other.

11. The image forming apparatus according to claim 8, further comprising a frame disposed facing the drive unit; and an opening formed on the frame, wherein the drive unit is attached from outside the body.

* * * * *